US009040469B2

(12) United States Patent
Długołęcki

(10) Patent No.: US 9,040,469 B2
(45) Date of Patent: May 26, 2015

(54) LUBRICANT OF SOLID OR LIQUID CONSISTENCY, EXHIBITING LOW COEFFICIENT OF FRICTION

(76) Inventor: Jacek Długołęcki, Gdańsk (PL)

( * ) Notice: Subject to any disclaimer, the term of this patent is extended or adjusted under 35 U.S.C. 154(b) by 77 days.

(21) Appl. No.: 13/373,653

(22) Filed: Nov. 23, 2011

(65) Prior Publication Data

US 2012/0135897 A1 May 31, 2012

(30) Foreign Application Priority Data

Nov. 26, 2010 (PL) ..... 393059
Feb. 18, 2011 (PL) ..... 393958
Oct. 21, 2011 (PL) ..... 396720

(51) Int. Cl.

*C10M 169/00* (2006.01)
*C10M 117/00* (2006.01)
*C10M 169/06* (2006.01)
*C10M 129/40* (2006.01)
*C10M 129/44* (2006.01)

(52) U.S. Cl.

CPC ..... *C10M 129/40* (2013.01); *C10M 129/44* (2013.01); *C10M 2201/041* (2013.01); *C10M 2201/05* (2013.01); *C10M 2201/065* (2013.01); *C10M 2201/066* (2013.01); *C10M 2201/103* (2013.01); *C10M 2201/105* (2013.01); *C10M 2203/1025* (2013.01); *C10M 2207/126* (2013.01); *C10M 2207/128* (2013.01); *C10M 2213/062* (2013.01); *C10M 2229/02* (2013.01); *C10N 2210/01* (2013.01); *C10N 2210/02* (2013.01); *C10N 2210/03* (2013.01); *C10N 2220/082* (2013.01); *C10N 2230/06* (2013.01); *C10N 2250/10* (2013.01)

(58) Field of Classification Search

CPC . C10M 117/04; C10M 117/00; C10M 119/22
USPC ..... 508/122, 519
See application file for complete search history.

(56) References Cited

U.S. PATENT DOCUMENTS 4,719,023 A * 1/1988 MacPhail et al. ..... 508/460
6,100,226 A * 8/2000 Konzman et al. ..... 508/423
6,319,880 B1 11/2001 Okaniwa et al.
2003/0087768 A1* 5/2003 Florchinger et al. ..... 508/144
2005/0003970 A1 1/2005 Ohmura et al.
2005/0176594 A1* 8/2005 Grabowski et al. ..... 508/215
2006/0111256 A1* 5/2006 Kinoshita et al. ..... 508/552
2008/0312111 A1* 12/2008 Malshe et al. ..... 508/155
2009/0088354 A1* 4/2009 Berry et al. ..... 508/388
2009/0221457 A1 9/2009 Ikezawa

FOREIGN PATENT DOCUMENTS

EP 1752520 2/2007
EP 2316912 A1 5/2011
GB 603360 6/1948
PL 174758 9/1998
PL 176013 3/1999
PL 176309 5/1999
PL 183021 5/2002
WO WO2010/024056 A1 3/2010

OTHER PUBLICATIONS

"Leksykon Pauwa, Oleje, Snary sanochodowe" Papes 136-142, published by korunikacji Warsaw 1983.

* cited by examiner

*Primary Examiner* — Prem C Singh
*Assistant Examiner* — Francis C Campanell
(74) *Attorney, Agent, or Firm* — Horst M. Kasper

(57) ABSTRACT

The invention relates to a lubricant in the form of grease or thick lubricating gel or transmission oil, as well as motor or universal oils with a myriad of applications. As a result of its contents presented in the patent application is characteristic of low coefficient of friction ranging from 0.055 to 0.062. As the main component, the contents of the discussed lubricant includes three or four stearates of metals or hydroxistearates of metals, which interact and cause a noticeable reduction of friction drag on the lubricated surfaces. Additionally, these substances may include a number of other solid or liquid elements, which maintain low friction drags and, furthermore, improve the lubricant through increasing its load capacity, antirust characteristics, shear strength, etc. The lubricant made according to the invention underwent comparative tests against other greases and greasing oils, the accounts of which are included in the application as diagrams, descriptions of research tests and examples of the contents of the lubricant products.

20 Claims, 2 Drawing Sheets

LUBRICANT OF SOLID OR LIQUID CONSISTENCY, EXHIBITING LOW COEFFICIENT OF FRICTION

BACKGROUND OF THE INVENTION

1. Field of the Invention

This invention relates to a solid lubricant characterized by a low coefficient of friction. The lubricant is dedicated to the application in electro-mechanical, automotive, aviation and other industries, where the lubricant can be used as grease or transmission oil.

2. Brief Description of the Background of the Invention Including Prior Art

There are known greases, thick gels of lubricating characteristics as well as transmission, oils, which contain such components as for example mineral, synthetic or silicon oils, along organic origin substances or a combination of such oils mixed with other substances that make up the liquid base of lubricant, gel or oil and which contain various thickeners such as soaps and waxes, along with other substances that improve the product's lubricating or adhesive qualities, or lubricant's resistance to large mechanical loads.

There are known greases and oils of the coefficient of dynamic friction ranging from 0.09 to 0.13 defined in tribometers at revolving and skidding of two frontal cut surfaces of samples, i.e. lubricated cylinders. Some premium quality greases and transmission oils exhibit lower values of the coefficient of friction ranging from 0.078 to 0.09.

There are also known lubricants in the form of mixtures of greasing substances of low coefficient of friction ranging from 0.055 to 0.062, but they have a significant price that prevents their mass application in electromechanical or automotive industries. To lower the coefficient of friction to the level of 0.055-0.062, the known lubricants contain such substances as molybdenum disulfide and wolfram disulfide in proportion from 35 to 60 percent of lubricant's total volume. However, it results in their substantial price increase.

DESCRIPTION OF INVENTION AND PREFERRED EMBODIMENT

Lubricant of solid consistency, exhibiting low coefficient of friction, which contains liquid base and thickeners as solids, including but not limited to soaps, waxes, as well as other enriching agents, is characterized according to the present invention by containing at least three out of four metal soaps or alternately complex fragrance free metal soaps. The former include such substances as lithium-stearate or alternately lithium-hydroxistearate in the amount of 1% to 18% of weight, while the latter are such substances as calcium-stearate or alternately calcium-hydroxistearate in the amount of 1% to 18% of weight. The third metal soap is magnesium-stearate in the amount of 1% to 18% of weight, and the fourth one is aluminum-stearate in the amount of 1% to 18% of weight. The total contents of the above mentioned metal soaps ranges from 10% to 80% of weight, while the contents of the liquid structure ranges from 20% to 90% of weight.

In one embodiment of the invention the lubricant contains colloid silicon dioxide, preferably as aerosil, in an amount of not more than 4.5% of weight.

In another embodiment of the invention, the lubricant contains bentonite, in an amount of not more than 4.5% of weight.

In another embodiment of the invention, the lubricant contains technical talc powder in grains, with an overall dimension of each grain less than 35 μm in an amount of not more than 6.60% of weight.

In another embodiment of the invention, the lubricant contains polytetrafluoroethylene PTFE in powder or in grain consistency, with an overall dimension of each grain lower than 100 μm in an amount of 0.09% to 15.25% of weight.

In another embodiment of the invention of this invention, the lubricant contains polimethylsiloxane oil of viscosity from 10 to 1000 cSt, measured at a temperature of 40° C., in an amount of 0.29% to 4.8% of weight.

In another embodiment of the invention, the lubricant contains molybdenum disulfide $MoS_2$ in grain or of powder consistency with an overall dimension of each grain lower than 50 μm, in an amount of 0.45% to 10% of weight.

In another embodiment of the invention, the lubricant contains wolfram disulfide $WS_2$ in grain or powder consistency with an overall dimension of each grain lower than 20 μm in an amount of 0.45% to 10% of weight.

In another embodiment of the invention, the lubricant contains graphite powder with an overall dimension of each grain of the powder is lower than 100 μm in an amount of 0.45% to 10% of weight.

In another embodiment of the invention, the lubricant contains copper nuggets with an overall dimension of each nugget of not more than 80 μm in an amount of up to 18.5% of weight.

In another embodiment of the invention, the lubricant contains nuggets of a bearing alloy made of tin and/or lead of the hardness not more than 25 $Kg/mm^2$, according to the Brinell HB measurement method, with an overall dimension of each nugget of not more than 80 micrometers in an amount of up to 18.5% of weight.

In another embodiment of the invention, the lubricant contains tin or lead nuggets with an overall dimension of each nugget of not more than 80 μm in an amount of up to 18.5% of weight of each of these metals.

In another embodiment of the invention, the lubricant contains different lubricant preferably readymade in the form of grease or transmission oil in an amount of up to 87%. Consequently, readymade grease or transmission oil is supplemented with lubricant made according to the invention in the amount of more than 13% of the final mix with the aim to improve the characteristics of the final mix.

In yet another embodiment the metal soaps make up from 30.91% to 79.91% of the weight of a lubricating composition, while the liquid base ranges respectively from 69.09% to 20.09% by weight and is also characterized by that the lubricating composition contains at the same time polytetrafluoroethylene PTFE with an overall dimension of the grains below 100 μm in the amount from 0.09% to 15.25% by weight.

SUMMARY OF FEATURES OF THE INVENTION

The invention is applicable as solid greasing substance in highly loaded interacting shaped surfaces as a universal lubricant in the form of grease or lubrication gel in all types of technical equipment, particularly in engines as well as gear, helix and planetary transmissions, including skid and ball-bearings under heavy load.

The invention is characterized by a low dynamic friction, what results in cost savings in the utilization of technical products, operational benefits from improved equipment capacity, reduction of the temperature of grease or transmission oil in the equipment and lower energy losses as well as aging of transmission oil or grease.

The invention is applicable in operation and maintenance of machines and equipment as well as transmission gears in working machines. It falls under the group of maintenance materials required for operation of equipment and subassemblies manufactured in the electromechanical and motor industries. Through application of the greasing agent made according to the invention, the generated heat as well as the amount of energy lost in traction of the lubricated surfaces becomes considerably reduced by at least 25%.

Furthermore, the invention is complementary to other available lubricants to improve their chemical and physical as well as operational characteristics. To that aim, the existing lubricant is mixed with the lubricant made according to this invention.

Another benefit of the invention is that it may be applied as grease or lubrication gel for transmission as one of different applications.

The following examples illustrate in detail the present invention in various of its embodiments.

Example 1

The lubricant made as grease contains liquid base in the form of heavy paraffin oil in the amount of 59% by weight and 5% of lithium-stearate, or alternatively lithium-hydroxistearate, 11% of calcium-stearate, or alternatively calcium-hydroxistearate, 9% of magnesium-stearate, and 9% of aluminum-stearate. The contents of the discussed lubricant were supplemented with 5% of polytetrafluoroethylene PTFE and 2% of colloid silicon dioxide $SiO_2$.

The said lubricant is characterized by the coefficient of friction less than 0.065.

Example 2

The lubricant made as grease contains a base in the form of mineral motor oil in the amount of 56% of its total weight, while other components include as follows: 7% of lithium-stearate, or alternatively lithium-hydroxistearate; 14% of calcium-stearate, or alternatively calcium-hydroxistearate, and 9% of magnesium-stearate. The contents of the discussed lubricant were supplemented with 8% of polytetrafluoroethylene PTFE and 2% of colloid silicon dioxide $SiO_2$. Furthermore, the contents was supplemented with polimethylsiliconoxide oil of viscosity of 1000 cSt, measured at a temperature of 40° C., in an amount of 4% of lubricant's total weight.

The said lubricant is characterized by the coefficient of friction less than 0.066.

Example 3

The lubricant made as greasing gel for helix transmissions, characterized by a very thick transmission oil, contains a base in the form of heavy paraffin oil in the amount of 70% of gel's total weight, while other components include as follows: 6% of polytetrafluoroethylene PTFE, 6% of lithium-stearate, or alternatively lithium-hydroxistearate, 8% of calcium-stearate, or alternatively calcium-hydroxistearate, 4% of magnesium-stearate, 4% of aluminum-stearate, and 2% of colloid silicon dioxide $SiO_2$.

The said lubricant is characterized by the coefficient of friction less than 0.063.

Example 4

The lubricant of the same contents as described in Example 3 above, except supplemented with molybdenum disulfide $MoS_2$ in the amount of 3.5% by weight.

This product is applicable as grease in helix transmissions and has a coefficient of friction below 0.059.

The coefficient of friction μ of the lubricant made according to the invention measured with the so-called vertical tribometer in a comparative test of two greases—one of them was made according to the invention, which demonstrates a change of the coefficient of friction of the grease according to the invention in the function of time on the diagram in FIG. 1, and the other, using a very expensive grease available on the market, containing over 50% in the weight of molybdenum disulfide $MoS_2$, is shown in FIG. 2. Both FIG. 1 and FIG. 2 illustrate an evolving coefficient of friction under a ballast of grinded cylindrical steel sample, loaded by a constant force of 7.2 kN resulting in nominal pressure of 50 MPa at sample's peripheral speed of 0.1 m/s.

The analysis of the figures mentioned above suggests that the friction drag and resulting coefficient of friction μ for both greases is generally identical in the tests presented on the diagrams in both figures, despite the fact that the grease with considerable amount of molybdenum disulfide (black in color) is much more expensive (because high price of molybdenum disulfide) than the product made according to the invention (white in color). This result was confirmed through a series of consecutive tests with a tribometer, including against a number of premium quality lubricants (FIG. 3 and FIG. 4).

Consequently, the lubricant made according to the present invention, i.e. grease made up of inexpensive substances, without costly additives, such as $MoS_2$, offers similar, very low friction drag, expressed by the coefficient of friction, as very expensive counterparts including substantial amounts of molybdenum disulfide $MoS_2$. This is an unexpected and significant result that supports the technical and economic advantages of the discussed inventive product.

FIG. 3 illustrates similar diagrams relevant for greases other than that in FIG. 2. It presents a function of the coefficient of friction to test duration of a high quality internationally recognized lubricant characteristic of high load capacities, offering a high level of protection against seizure and frictional corrosion. FIG. 4, on the other hand, presents a similar diagram for new generation grease manufactured for the marine applications and characteristic of high resistance to the salt water and mechanical pressures.

In the case of the grease presented on FIG. 3, the coefficient of friction μ is about 0.088, while the one on FIG. 4 demonstrates over 0.095. These results differ substantially in the friction drag from those recorded on FIG. 1 and FIG. 2, whose values are approximately from 0.055 to 0.065, respectively, relevant to the lubricants of medium and high quality available on the market and depicted in the diagrams on FIG. 3 and FIG. 4.

Thus, in the case of the grease made according to the invention, of the coefficient of friction μ of about 0.06 (FIG. 1), and the grease presented on FIG. 3, of μ of about 0.088, the reduction of the coefficient of friction and friction drag as well as a corresponding reduction of energy loss, most frequently in the form of heat passing through the walls of equipment, will be: $[(0.088 \text{ minus } 0.06)/0.088]\times100\%$, which produces a surprising result of 31.8% of savings of the motion energy and a reduction of the skidding friction drag by 31.8%.

The analysis of the above mentioned results suggests that the interaction of several stearates of metals or hydroxistearates of metals present in grease's contents offers considerable reduction of its coefficient of friction, by at least a dozen of percent in comparison to other established lubricants of premium quality.

BRIEF DESCRIPTION OF THE SEVERAL VIEWS OF THE DRAWINGS

The essence of the invention and its benefits, particularly the reduction of solid lubricant's coefficient of friction and skidding friction drag achieved in the comparative test, are demonstrated on the following figures.

Figure 1:
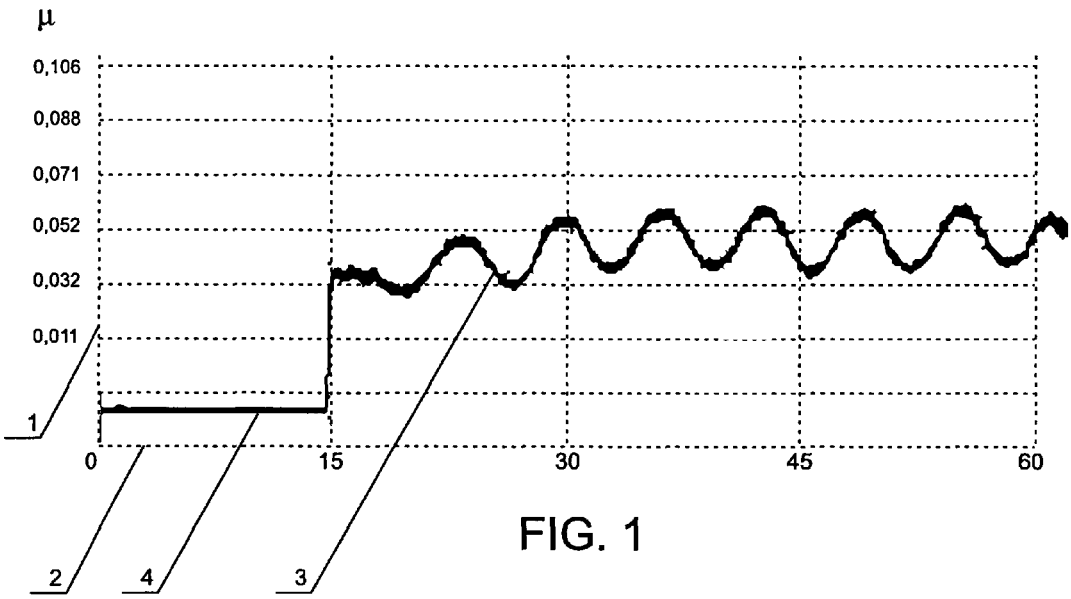
FIG. 1—presents an exemplary diagram of the value of the coefficient of friction μ throughout the duration of the test performed with a tribometer for the grease made according to the invention.
Figure 2:
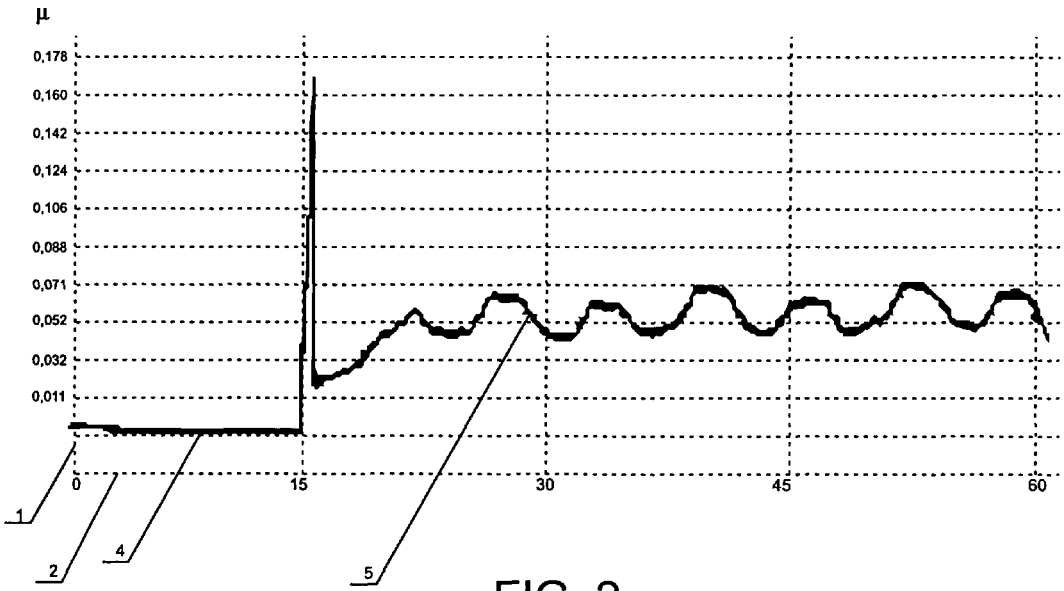
FIG. 2—presents an exemplary diagram of the value of the coefficient of friction μ throughout the duration of the test performed with a tribometer for reputable grease with an over 50% content of molybdenum disulfide $MoS_2$.
Figure 3:
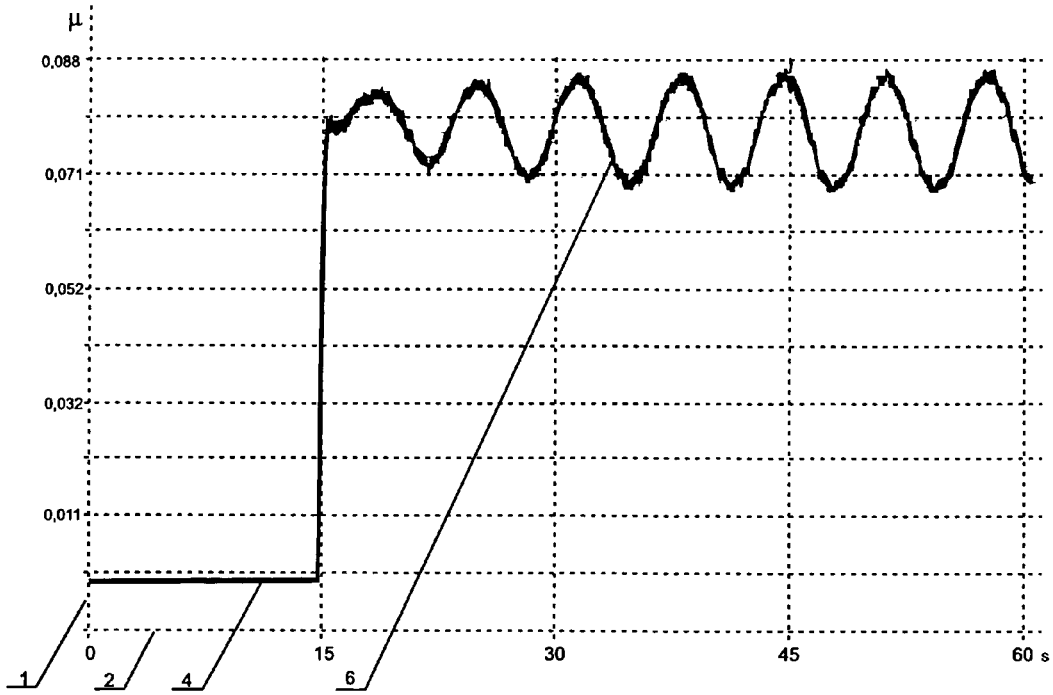
FIG. 3—presents an exemplary diagram of the value of the coefficient of friction μ throughout the duration of the test performed with a tribometer for reputable premium quality product characteristic of a high load capacity and superior anti-seizure protection.
Figure 4:
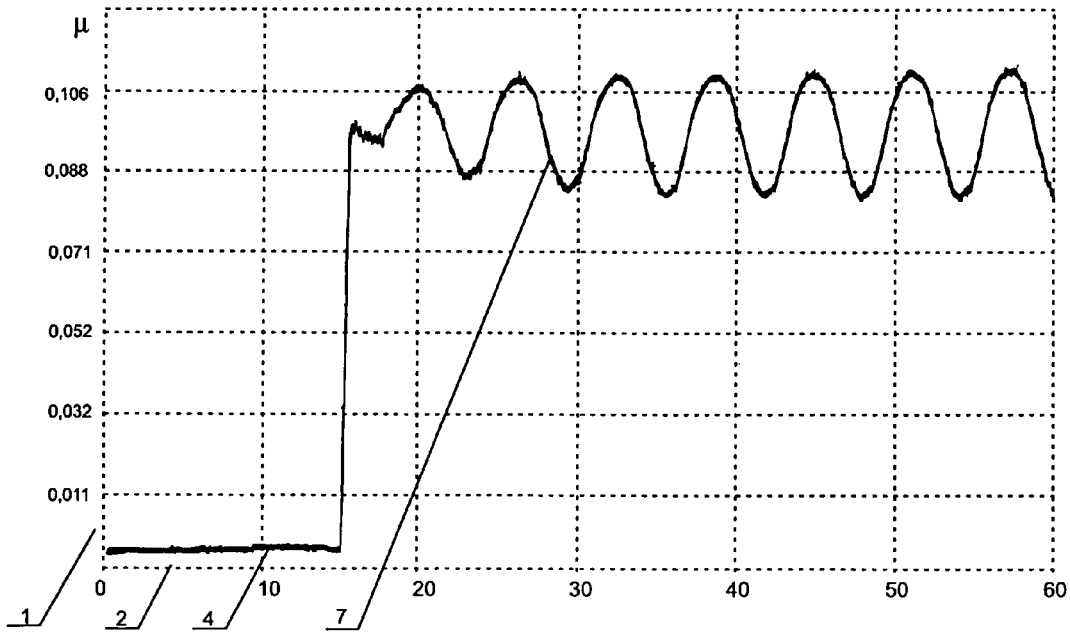
FIG. 4—presents an exemplary diagram of the value of the coefficient of friction μ throughout the duration of the test performed with a tribometer for reputable grease applied in shipbuilding, characteristic of high resistance to substantial loads and salt water effects.

The diagrams on FIG. 1 to FIG. 4 represent the following information: 1—grid's vertical Y-axis depicts the coefficient of friction u measured with a tribometer. 2—grid's horizontal X-axis depicts the duration of the coefficient of friction test with a tribometer expressed in seconds.

3—run of the coefficient of friction curve for the grease made according to the invention in a tribometer test throughout its duration in seconds.

4—run of the coefficient of friction curve during tribometer's idle mode in the consecutive tests of the grease.

5—run of the coefficient of friction curve for reputable grease with an over 50% content of molybdenum disulfide $MoS_2$ throughout the duration of the test in seconds.

6—run of the coefficient of friction curve for a reputable premium quality grease resistant to high loads on the lubricated surfaces and significant anti-seizure characteristics throughout the duration of the test in seconds.

7—run of the coefficient of friction curve for reputable grease applied in ship building characteristic of resistance to high loads and salt water effects throughout the duration of the test in seconds.

Example 5

The lubricant as grease contains liquid base in the form of heavy paraffin oil in the amount of 59% of its total weight and 5% of lithium-stearate, or alternatively lithium-hydroxistearate, 11% of calcium-stearate, or alternatively calcium-hydroxistearate, 9% of magnesium-stearate, and 9% of aluminum-stearate. The contents of the discussed lubricant were supplemented with 5% of polytetrafluoroethylene PTFE and 2% of colloid silicon dioxide $SiO_2$.

The lubricant is characterized by the coefficient of friction of 0.065.

Example 6

The lubricant of the contents as in Example 5, although supplemented with 2% of graphite powder.

The lubricant is characterized by of the coefficient of friction below 0.065.

Example 7

A readymade grease of constant coefficient of friction of 0.087 undergoes an enrichment process by supplementing it with 30% of solid grease made according to the invention. The grease in the amount of 30% of lubricant's total weight added to the readymade product has the following contents: 50% of heavy paraffin oil of the specific gravity of about 84 to 85 g/cm$^3$, 10% of lithium-stearate, or alternatively lithium-hydroxistearate, 14% of calcium-stearate, or alternatively calcium-hydroxistearate, 9% of magnesium-stearate, 9% of aluminum-stearate, 5% of polytetrafluoroethylene PTFE, and 3% of colloid silicon dioxide $SiO_2$.

The enriched solid grease is characteristic of the coefficient of friction below 0.067.

Example 8

The lubricant as a lubricating composition contains lithium-stearate or alternately lithium-hydroxistearate in the amount of from 1% to 18% by weight, calcium-stearate or alternately calcium-hydroxistearate in the amount of from 1% to 18% by weight, magnesium-stearate in the amount of from 1% to 18% by weight, aluminum-stearate in the amount of from 1% to 18% by weight, aforesaid metal soaps make up from 30.91% to 79.91% of the weight of the lubricating composition, while the liquid base ranges respectively from 69.09% to 20.09% by weight and also is characterized by that it simultaneously comprises polytetrafluoroethylene PTFE with an overall dimension of the grains below 100 μm in the amount from 0.09% to 15.25% by weight.

Example 9

The lubricant as transmission oil is made up of a base in the form of mineral oil in the amount of 78% of its total weight, Moreover, the content includes as follows: 4% of polytetrafluoroethylene PTFE, 5% of lithium-stearate, or alternatively lithium-hydroxistearate, 4% of calcium-stearate, or alternatively calcium-hydroxistearate, 3% of magnesium-stearate, 3% of aluminum-stearate, and 3% of colloid silicon dioxide $SiO_2$, Additionally, the lubricant includes 2% of molybdenum disulfide MoS2.

This lubricating composition features the coefficient of friction below 0.061.

The invention claimed is:

1. A lubricant of solid consistency, exhibiting a low coefficient of friction, ranging from 0.044 to 0.067, with a liquid base and thickeners as solids, containing a mixture of three out of four metal soaps namely lithium-stearate, or alternately lithium-hydroxystearate, in the amount of from 5% to 10% by weight, calcium-stearate, or alternately calcium-hydroxystearate, in the amount of from 4% to 14% by weight, magnesium-stearate in the amount of from 3% to 9% by weight, or aluminum-stearate in the amount of from 3% to 9% by weight, and at the same time containing polytetrafluoroethylene in the amount from 4% to 8% by weight, and aforesaid metal soaps make up from 51% to 80% of the weight of a lubricating composition, while the liquid base ranges respectively from 49% to 20% by weight.

2. The lubricant according to claim 1, wherein the lubricant contains colloidal silicon dioxide in an amount of not more than 4.5% by weight.

3. The lubricant according to claim 1, wherein the lubricant contains soaps and waxes.

4. The lubricant according to claim 1, wherein the lubricant contains talc powder in grains, wherein an overall dimension of each grain is below 35 μm, but more than 2 μm, in an amount of not more than 6.60% by weight.

5. The lubricant according to claim 1, wherein the lubricant contains polytetrafluoroethylene in powder or in a grain consistency, wherein an overall dimension of each grain is below 100 μm, but more than 2 μm, in the amount from 0.09% to 15.25% by weight.

6. The lubricant according to claim 1, wherein the lubricant contains polimethylsiloxane oil of viscosity from 10 cSt to 1000 cSt, measured in temperature of 40° C., in an amount of from 0.29% to 4.8% by weight.

7. The lubricant according to claim 1, wherein the lubricant contains molybdenum disulfide in grain or powder consistency, wherein an overall dimension of each grain is lower than 50 μm, but for up to 10% by weight more than 2 μm, in an amount of from 0.45% to 10% by weight.

8. The lubricant according to claim 1, wherein the lubricant contains tungsten disulfide in grains or powder consistency, wherein an overall dimension of each grain is lower than 20 μm, but for up to 10% by weight more than 2 μm, in an amount of from 0.45% to 10% by weight.

9. The lubricant according to claim 1, wherein the lubricant contains graphite powder in grains, wherein an overall dimension of each grain of the powder is lower than 20 μm, but for up to 10% by weight more than 2 μm, in an amount of from 0.45% to 10% by weight.

10. The lubricant according to claim 1, wherein the lubricant contains copper nuggets, wherein an overall dimension of each nugget is no more than 80 μm, in an amount of up to 18.5% by weight.

11. The lubricant according to claim 1, wherein the lubricant contains nuggets of a bearing alloy made of tin and/or lead of the firmness of not more than 25 $Kg/mm^2$, according to the Brinell HB measurement method, wherein an overall dimension of each nugget is not more than 80 μm, but for up to 10% by weight more than 2 μm, in an amount of up to 18.5% by weight.

12. The lubricant according to claim 1, wherein the lubricant contains nuggets of tin or nuggets of lead wherein an overall dimension of each nugget is less than 80 μm, but more than 2 μm, in an amount of nuggets of tin or nuggets of lead of not more than 18.5% by weight.

13. The lubricant according to claim 1, wherein the lubricant contains another lubricant as grease or a lubrication gel for transmission in the amount of up to 87% by weight.

14. A lubricant of solid consistency, exhibiting the low coefficient of friction, ranging from 0.044 to 0.067, with the liquid base and thickeners as solids, consisting of a mixture of three out of four metal soaps, namely lithium-stearate or alternately lithium-hydroxystearate in the amount of from 5% to 10% by weight, calcium-stearate or alternately calcium-hydroxystearate in the amount of from 4% to 14% by weight, magnesium-stearate in the amount of from 3% to 9% by weight, or aluminum-stearate in the amount of from 3% to 9% by weight, and aforesaid metal soaps make up from 50.91% to 79.91% of the weight of the lubricating composition, while the liquid base ranges respectively from 49.09% to 20.09% by weight and also is characterized by that the lubricant contains at the same time polytetrafluoroethylene PTFE with an overall dimension of the grains below 100 μm, but more than 2 μm, in the amount from 4% to 8% by weight.

15. The lubricant according to claim 14, wherein the lubricant is applied to reduce frictional resistance between lubricated surfaces.

16. The lubricant of solid consistency, according to claim 14, made as grease containing the liquid base in the form of heavy paraffin oil in an amount of 59% by weight and 1-5% of lithium-stearate, or alternatively lithium-hydroxystearate, 1-11% of calcium-stearate, or alternatively calcium-hydroxystearate, 1-9% of magnesium-stearate, 1-9% of aluminum-stearate, with contents of said lubricant supplemented with 4-8% of polytetrafluoroethylene PTFE, and 2% of colloidal silicon dioxide $SiO_2$, and the said lubricant having a coefficient of friction of less than 0.065.

17. The lubricant according to claim 14, made as greasing gel for helix transmissions, characterized by a very thick transmission oil, containing a base in the form of heavy paraffin oil in the amount of 70% of gel's total weight, while other components include 4-8% of polytetrafluoroethylene PTFE, 1-6% of lithium-stearate, or alternatively lithium-hydroxystearate, 1-8% of calcium-stearate, or alternatively calcium-hydroxystearate, 1-4% of magnesium-stearate, 1-4% of aluminum-stearate, and 2% of colloid silicon dioxide $SiO_2$, the said lubricant having the coefficient of friction less than 0.063.

18. The lubricant according to claim 14, wherein transmission oil is made up of a base in the form of mineral oil in the amount of 78% of its total weight, while other components include 4-8% of polytetrafluoroethylene PTFE, 1-5% of lithium-stearate, or alternatively lithium-hydroxystearate, 1-4% of calcium-stearate, or alternatively calcium-hydroxystearate, 1-3% of magnesium-stearate, 1-3% of aluminum-stearate, and 3% of colloid silicon dioxide $SiO_2$, 2% of molybdenum disulfide MoS2, the said lubricant having the coefficient of friction below 0.061.

19. The lubricant according to claim 5, wherein the amount of polytetrafluoroethylene PTFE in various embodiments of the lubricating composition is in the established amount.

20. The lubricant according to claim 14, wherein the lubricant contains soaps and waxes.

* * * * *